US011898355B2

(12) United States Patent
Van Wey et al.

(10) Patent No.: US 11,898,355 B2
(45) **Date of Patent: *Feb. 13, 2024**

(54) ADHESIVE ASSEMBLED RIDGE VENT

(71) Applicant: Liberty Plastics, Inc., New Hope, MN (US)

(72) Inventors: Scott Charles Van Wey, Maple Grove, MN (US); Nick T. Nobbe, Mound, MN (US)

(73) Assignee: Liberty Plastics, Inc., New Hope, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/898,714

(22) Filed: Aug. 30, 2022

(65) Prior Publication Data

US 2022/0412096 A1 Dec. 29, 2022

Related U.S. Application Data

(63) Continuation of application No. 16/745,455, filed on Jan. 17, 2020, now Pat. No. 11,434,642.

(60) Provisional application No. 62/798,567, filed on Jan. 30, 2019.

(51) Int. Cl.
*E04D 13/17* (2006.01)
*E04D 1/36* (2006.01)

(52) U.S. Cl.
CPC ..... *E04D 13/176* (2013.01); *E04D 1/36* (2013.01)

(58) Field of Classification Search
CPC ..... E04D 13/176; E04D 1/36
See application file for complete search history.

(56) References Cited

U.S. PATENT DOCUMENTS 5,054,254 A * 10/1991 Sells ..... E04D 13/174 454/365
2007/0117505 A1* 5/2007 Wey ..... E04D 13/176 454/366

* cited by examiner

*Primary Examiner* — Patrick J Maestri
(74) *Attorney, Agent, or Firm* — Barnes & Thornburg LLP

(57) ABSTRACT

A venting device of a structure is provided that includes first and second panel sections. The first panel section includes a top panel portion and a base panel portion located opposite the top panel portion. The second panel section includes a top panel portion and a base panel portion located opposite the top panel portion. A bottom surface of the base panel portion of the first panel section faces a top surface of the top panel portion of the second panel section. A polyurethane reactive (PUR) adhesive is located between the bottom surface of the base panel portion of the first panel section and the top surface of the top panel portion of the second panel section which holds the bottom surface of the base panel portion of the first panel section and the top surface of the top panel portion of the second panel section together.

18 Claims, 13 Drawing Sheets

ADHESIVE ASSEMBLED RIDGE VENT

RELATED APPLICATIONS

The present application is a continuation of application Ser. No. 16/745,455 filed on Jan. 17, 2020 entitled "Adhesive Assembled Ridge Vent" and is related to and claims priority to U.S. Provisional Patent Application, Ser. No. 62/798,567, filed on Jan. 30, 2019, entitled "Adhesive Assembled Ridge Vent." The subject matter disclosed in these applications are hereby expressly incorporated into the present Application in its entirety.

TECHNICAL FIELD AND SUMMARY

The present disclosure relates to roof ventilating devices and, in particular, to new roof ventilating devices assembled with an adhesive, as well as methods of making same.

It is a common practice in the construction of dwellings, such as houses, to ventilate gable roofs by providing a vent along the roof ridge. Ventilation apertures are formed in the construction process by leaving or cutting an open slot along the ridge through the sheathing material covering the roof. Heated air rises and escapes at the ridge taking with it moisture that may have accumulated within the roof. The flow of wind over the ridge of the roof assists in the extraction of moisture and heated air by creating a zone of relatively reduced pressure as it crosses the ridge. Soffit vents covering the undersides of overhanging eaves in the roof enable entry of fresh exterior air into the roof to replace air that has left through the ridge vent.

Snow is also of concern. It has a small particle size and is lightweight. Wind can carry snow upward and into roof vents. Ideally, a ventilated roof provides for an unrestricted outflow of air through the soffit vents and out through the ridge vent. Without protection of the ventilating openings, however, windblown precipitation, debris, and insects may enter the roof and encourage damage to the structure through mildew, rot, and infestation. A ventilated cap or ridge vent is therefore placed over the open slot in the ridge and attached to the roof along each side.

A ridge vent structure particularly adept at mitigating such issues is disclosed in U.S. Pat. No. 6,913,530 ('530 patent) to Morris, et al., entitled "Precipitation Resistant Ridge Vent," issued Jul. 5, 2005. The disclosure of the '530 patent is herein incorporated by reference. Such ridge vent has layered fluted panels as shown in FIGS. 1, 2, 3, 4, 6, and 7 of the '530 patent. These fluted panels are stacked on each side of a top panel (see, e.g., 7A of the '530 patent) to allow air to flow through, but prevent precipitation, debris, and insects, for example, from passing through as well.

Assembly of these ridge vents shown in the '530 patent require the stacks of vent panels to be attached to the top panel via staples or like mechanical fasteners, such as fastener 62 shown in FIG. 1 of the '530 patent. Such fasteners secure the vent panels to the top panel and have the ability to withstand the environmental rigors experienced by such structures that will sit on roof peaks for extended periods of time. And, although adhesives may have been perceived as a viable alternative, the environmental factors and the manufacture process of ridge vents of the type disclosed in the '530 patent, adhesives were not.

It became known to the skilled artisan that liquid adhesives (i.e., glues) could not withstand the extreme cold and heat that a ridge vent would be subjected to on a roof. Adhesives could not hold the stacked panels together under such conditions. Furthermore, manufacturing such a ridge vent using an adhesive was a challenge. Each stack of vent panels was not necessarily perfectly planar. Adhesives did not fill gaps between peaks and valleys inherent on the mating surfaces of adjoining vent panels. This meant less surface contact between the vent panels and the adhesive. Also, the green strength of the adhesive (i.e., the adhesive's initial bond strength) was not sufficient to create an initial bond that allowed further manufacturing of the ridge vent. Furthermore, the use of adhesives significantly hindered the manufacturing process due to the extra time required to allow the adhesive to establish and solidify a bond with the vent panels.

Adhesives were also determined to not be able to withstand the extreme temperatures present on a roof when installed. The temperature of the glue was problematic in that the operating temperature was narrow. If, when applied, the glue was a few degrees cooler the vent would not bond. Conversely, if, when applied, the glue was a few degrees hotter, it might melt the vent material. Still further, the temperature of the vent material itself could affect the bond. Accordingly, it is believed known to the skilled artisan that adhesives, indeed, cannot be used to assemble ridge vents of the type disclosed in the '530 patent. As a result, adhesives proved insufficient as an attachment means for vent panels.

Unexpectedly, and contrary to what is known in the art, a ridge vent of the type disclosed in the '530 patent can be assembled by employing an adhesive. No longer are fasteners, such as fasteners 62, shown in FIG. 1 of the '530 patent, necessary to secure the vent panel stacks together, nor attach those stacks to the top panel of the ridge vent. Previously, unknown to the skilled artisan, and as further disclosed herein, a particular adhesive—a polyurethane reactive (PUR) adhesive may be used in place of mechanical fasteners.

Accordingly, an illustrative embodiment of the present disclosure provides a venting device of a structure comprising: an elongate first panel section that includes a multiplicity of discrete air passages; wherein the multiplicity of discrete air passages of the elongate first panel section is bounded by a top panel portion and a base panel portion located opposite the top panel portion; an elongate second panel section that includes a multiplicity of discrete air passages; wherein the multiplicity of discrete air passages of the elongate second panel section is bounded by a top panel portion and a base panel portion located opposite the top panel portion; wherein a bottom surface of the base panel portion of the elongate first panel section faces a top surface of the top panel portion of the elongate second panel section; wherein at least one of the bottom surface of the base panel portion of the elongate first panel section and the top surface of the top panel portion of the elongate second panel section has been subject of a corona treatment; and wherein a polyurethane reactive (PUR) adhesive is located between the bottom surface of the base panel portion of the elongate first panel section and the top surface of the top panel portion of the elongate second panel section which holds the bottom surface of the base panel portion of the elongate first panel section and the top surface of the top panel portion of the elongate second panel section together.

In the above and other illustrative embodiments, the venting device may further comprise: an elongate third panel section that includes a multiplicity of discrete air passages, wherein the multiplicity of discrete air passages of the elongate third panel section is bounded by a top panel portion and a base panel portion located opposite the top panel portion, wherein a bottom surface of the base panel portion of the elongate second panel section faces a top surface of the top panel portion of the elongate third panel section, wherein at least one of the bottom surface of the base panel portion, of the elongate second panel section, and the top surface of the top panel portion of the elongate third panel section, has been subject of a corona treatment, wherein a PUR adhesive is located between the bottom surface of the base panel portion of the elongate second panel section, and the top surface of the top panel portion of the elongate third panel section which holds the bottom surface of the base panel portion of the elongate second panel section and the top surface of the top panel portion of the elongate third panel section, together; both the bottom surface of the base panel portion of the elongate first panel section and the top surface of the top panel portion of the elongate second panel section have been subject of the corona treatment; both the bottom surface of the base panel portion of the elongate second panel section and the top surface of the top panel portion of the elongate third panel section have been subject of the corona treatment; at least one gap is located between a portion of the at least one of the bottom surface of the base panel portion of the elongate first panel section and a portion of the top surface of the top panel portion of the elongate second panel section, wherein at least a portion of the PUR adhesive fills at least a portion of the gap; the elongate first panel section and elongate second panel section are not held together by a mechanical fastener; the venting device being sized to cover an opening located on a roof; the elongate first panel section and elongate second panel section are composed of a high-density polyethylene plastic; the PUR adhesive located between the bottom surface of the base panel portion of the elongate first panel section, and the top surface of the top panel portion of the elongate second panel section, holds the bottom surface of the base panel portion of the elongate first panel section, and the top surface of the top panel portion of the elongate second panel section, together in an outdoor environment; at least one line of PUR adhesive extends at least a portion of a length of the elongate first panel section and the elongate second panel section; and a plurality of lines of PUR adhesive extends at least a portion of the length of the elongate first panel section and the elongate second panel section.

Another illustrative embodiment of the present disclosure provides a venting device of a structure comprising: an elongate first panel section; wherein the elongate first panel section includes a top panel portion and a base panel portion located opposite the top panel portion; an elongate second panel section; wherein the elongate second panel section includes a top panel portion and a base panel portion located opposite the top panel portion; wherein a bottom surface of the base panel portion of the elongate first panel section faces a top surface of the top panel portion of the elongate second panel section; and wherein a PUR adhesive is located between the bottom surface of the base panel portion of the elongate first panel section, and the top surface of the top panel portion of the elongate second panel section, which holds the bottom surface of the base panel portion of the elongate first panel section, and the top surface of the top panel portion of the elongate second panel section together.

In the above and other illustrative embodiments, the venting device may further comprise: at least one of the bottom surface of the base panel portion of the elongate first panel section, and the top surface of the top panel portion of the elongate second panel section has been subject of a corona treatment; an elongate third panel section that includes a top panel portion and a base panel portion located opposite the top panel portion, wherein a bottom surface of the base panel portion of the elongate second panel section faces a top surface of the top panel portion of the elongate third panel section, wherein at least one of the bottom surface of the base panel portion of the elongate second panel section and the top surface of the top panel portion of the elongate third panel section has been subject of a corona treatment, and wherein a PUR adhesive is located between the bottom surface of the base panel portion of the elongate second panel section and the top surface of the top panel portion of the elongate third panel section which holds the bottom surface of the base panel portion of the elongate second panel section and the top surface of the top panel portion of the elongate third panel section together; both the bottom surface of the base panel portion of the elongate first panel section and the top surface of the top panel portion of the elongate second panel section have been subject of the corona treatment; at least one gap being located between a portion of the at least one of the bottom surface of the base panel portion of the elongate first panel section and a portion of the top surface of the top panel portion of the elongate second panel section, wherein at least a portion of the PUR adhesive fills at least a portion of the gap; the elongate first panel section and elongate second panel section are composed of a high-density polyethylene plastic; the PUR adhesive located between the bottom surface of the base panel portion of the elongate first panel section and the top surface of the top panel portion of the elongate second panel section holds the bottom surface of the base panel portion of the elongate first panel section and the top surface of the top panel portion of the elongate second panel section together in an outdoor environment; and at least one line of PUR adhesive extends at least a portion of a length of the elongate first panel section and the elongate second panel section.

Another illustrative embodiment of the present disclosure provides a method of making a venting device. The method comprising the steps of: providing an elongate first panel section that includes a top panel portion and a base panel portion located opposite the top panel portion; providing an elongate second panel section that includes a top panel portion and a base panel portion located opposite the top panel portion; facing a bottom surface of the base panel portion of the elongate first panel section toward a top surface of the top panel portion of the elongate second panel section; and applying a PUR adhesive that locates between the bottom surface of the base panel portion of the elongate first panel section and the top surface of the top panel portion of the elongate second panel section which holds the bottom surface of the base panel portion of the elongate first panel section and the top surface of the top panel portion of the elongate second panel section together.

Additional features and advantages of the adhesive assembled ridge vent will become apparent to those skilled in the art upon consideration of the following detailed descriptions exemplifying the best mode of carrying out the adhesive assembled ridge vent as presently perceived.

BRIEF DESCRIPTION OF THE DRAWINGS

The concepts described in the present disclosure are illustrated by way of example and not by way of limitation in the accompanying figures. For simplicity, and clarity of illustration, elements illustrated in the figures are not necessarily drawn to scale. For example, the dimensions of some elements may be exaggerated relative to other elements for clarity. Further, where considered appropriate, reference labels may be repeated among the figures to indicate corresponding or analogous elements.

Figure 1:
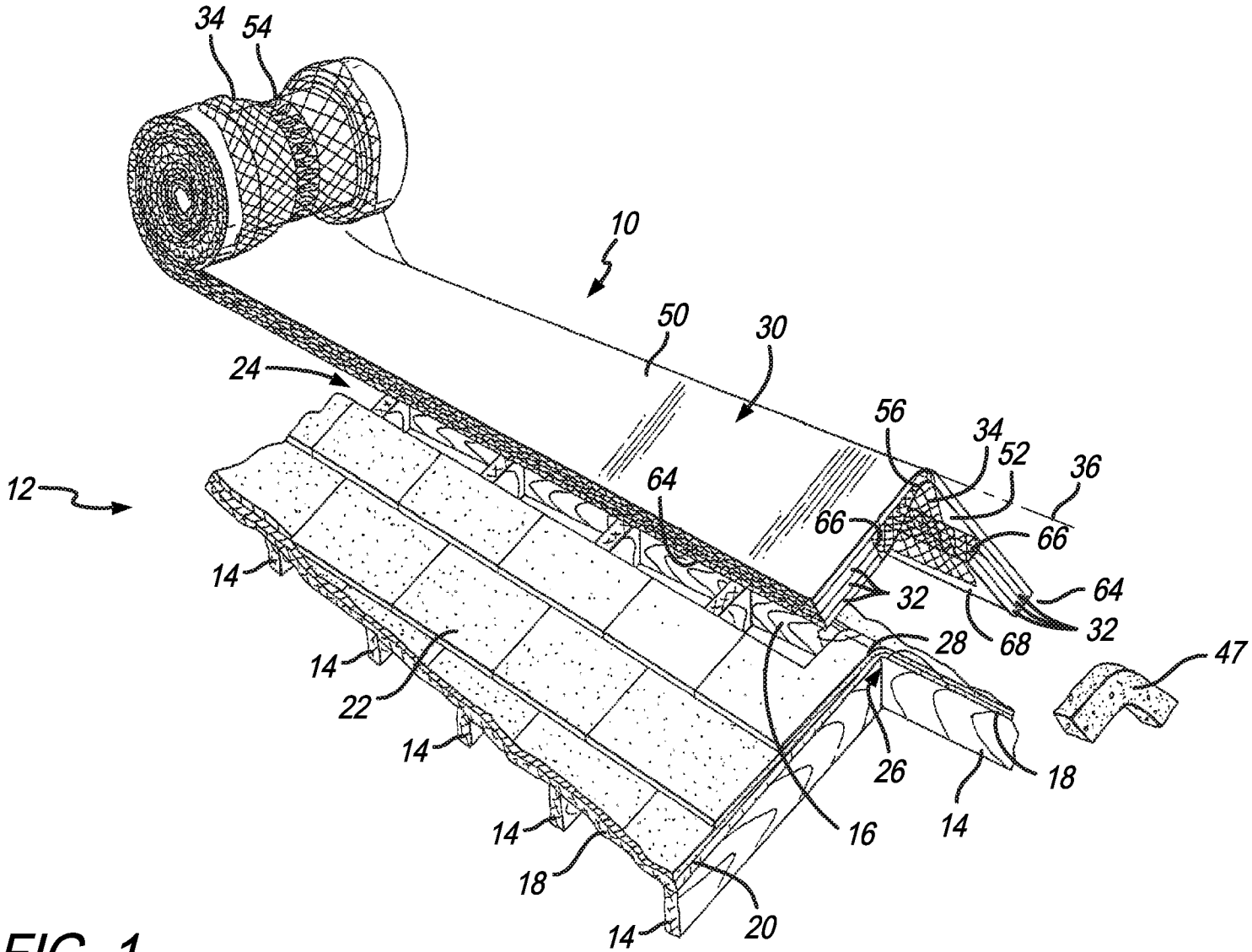
FIG. 1 is a perspective view of a precipitation resistant ridge cap roof vent being installed on a roof.

Corresponding reference characters indicate corresponding parts throughout the several views. The exemplification set out herein illustrates embodiments of the adhesive assembled ridge vent, and such exemplification is not to be construed as limiting the scope of the adhesive assembled ridge vent in any manner.

DETAILED DESCRIPTION OF THE DRAWINGS

The figures and descriptions provided herein may have been simplified to illustrate aspects that are relevant for a clear understanding of the herein described devices, systems, and methods, while eliminating, for the purpose of clarity, other aspects that may be found in typical devices, systems, and methods. Those of ordinary skill may recognize that other elements and/or operations may be desirable and/or necessary to implement the devices, systems, and methods described herein. Because such elements and operations are well known in the art, and because they do not facilitate a better understanding of the present disclosure, a discussion of such elements and operations may not be provided herein. However, the present disclosure is deemed to inherently include all such elements, variations, and modifications to the described aspects that would be known to those of ordinary skill in the art.

A perspective view of a precipitation resistant ridge cap roof vent 10, being installed on a roof 12, is shown in FIG. 1. The roof depicted is a rafter roof, though ridge vent 10 may be installed on many other types of roofs to provide ventilation. Roof 12 illustratively includes rafters 14 secured to a ridge board 16. Rafters 14 support sheathing 18. Sheathing 18 may be of plywood, oriented strand board, planks, or other suitable material secured to rafters 14. Generally, sheathing 18 is overlaid with tarred felt paper 20, which is, in turn, overlaid with shingles 22, though other roofing materials may be employed. A cutout slot 24 is provided along the ridge 26. Illustratively, cutout slot 24 may terminate some distance from end 28 of ridge 26.

Ridge cap roof vent 10 is attached to ridge 26 of roof 12, over previously made cutout slot 24, extending the length of ridge 26, except for a small portion which may be left uncut at each end of the roof 12. Cutout 24 may be larger than a cutout that would be used with a non-filtering ridge vent in order to compensate for the restriction of airflow caused by the filtering fabric 34. Ridge vent 10 may be unrolled, unfolded, or aligned if it is received packaged in either of these forms. Ridge vent 10 is disposed so that routed groove 54 is generally centered over cutout slot 24 and vent panels 32 are generally parallel to shingles 22 or other roof surface. It is appreciated that a resilient or conforming piece of material may be placed between ridge vent 10 and roof 12 to fill in any gaps that may be present due to irregularities in the roof structure. This may be helpful in the case of a corrugated metal or tiled roof. Once in place, a ridgeline of shingles 22 (or, alternatively, tiles, not shown) may be applied directly over ridge vent 10 (see, FIG. 2).

Figure 2:
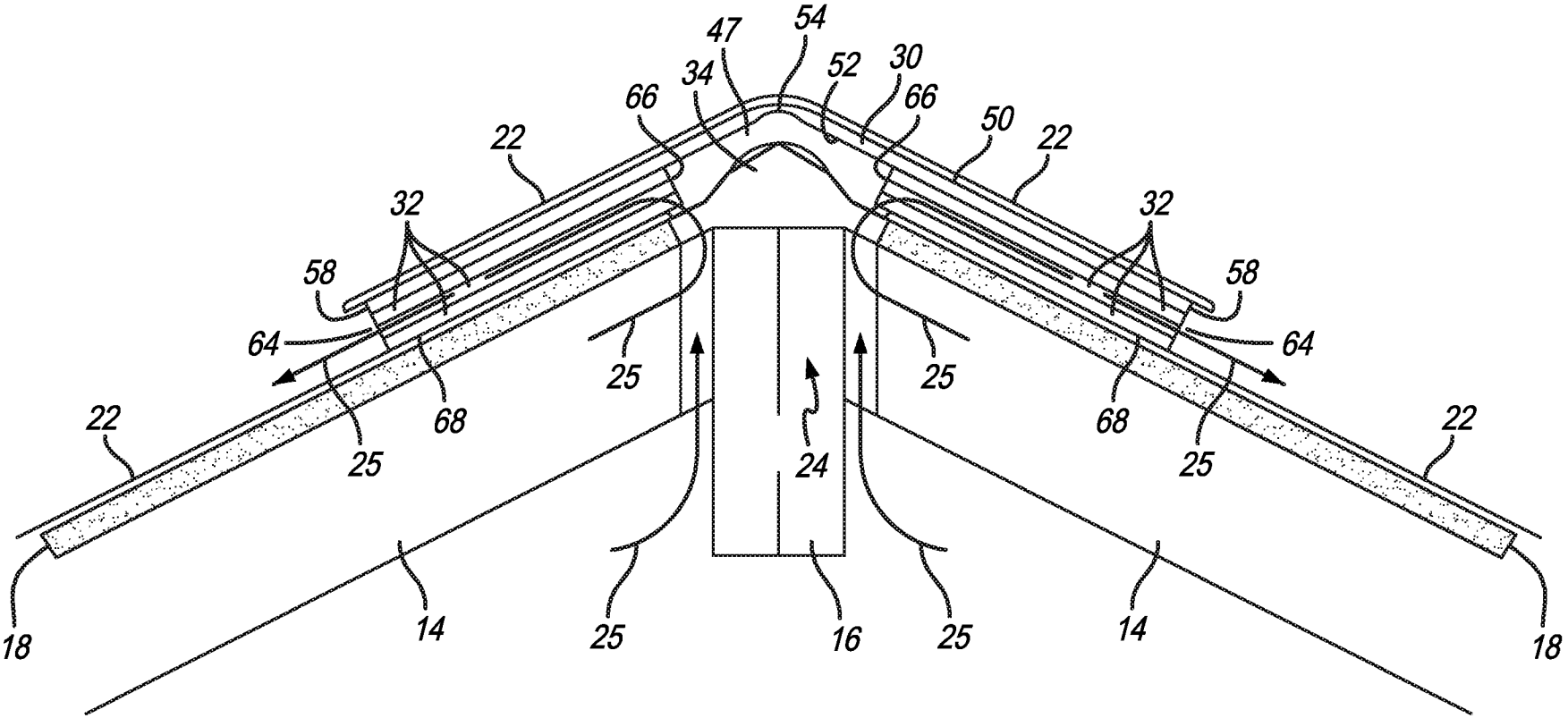
FIG. 2 is an end view of the ridge vent installed on a roof.

Ridge vent 10, as shown in FIG. 1, and also in an end view in FIG. 2, illustratively includes a top panel 30, a plurality of vent panels 32, and optionally a filtering fabric 34. Top panel 30 presents a longitudinal axis 36 aligned generally parallel or coincident to ridge 26 of roof 12 when ridge vent 10 is installed. Top panel 30 and vent panels 32 are constructed of a weatherproof three-ply material 38 fluted material (see FIGS. 3, 4, 5, 8, and 9). The weatherproof three-ply material 38 comprises panels of a high-density polyethylene (HDPE) plastic with several performance characteristics, including crush-resistance and enhanced material memory, which allows the material to return to its original shape when bent, compressed, or moved. The material is impact resistant, does not degrade or "whiten" when bent which is inherent with other plastic materials. The material can also withstand extreme temperatures. Top panel 30 also presents an exterior surface 50 and an interior surface 52. Interior surface 52 may illustratively include routed groove 54 extending generally parallel to longitudinal axis 36.

Figure 7:
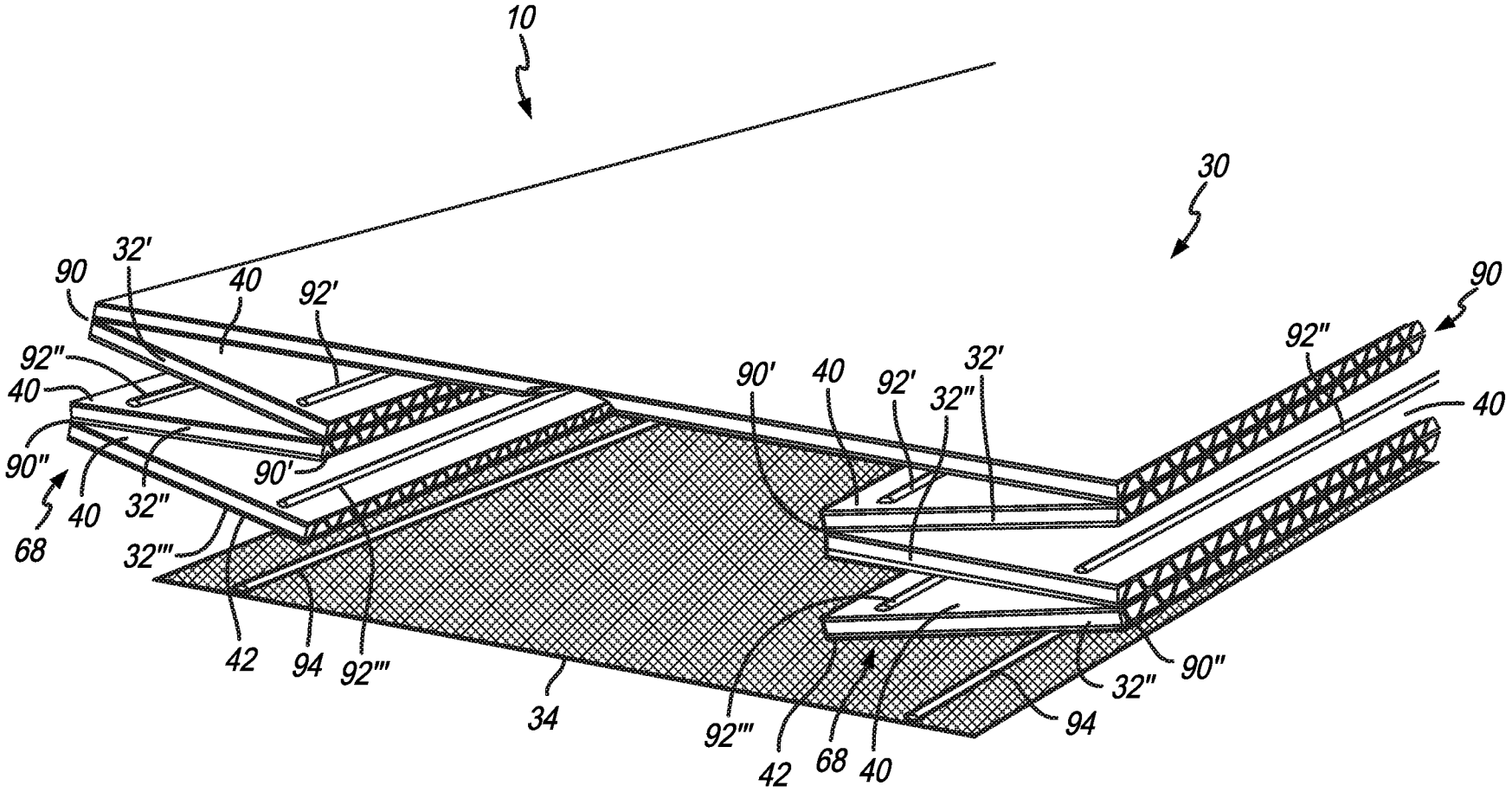
FIG. 7 is an unassembled perspective partially-exploded detail view of a portion of the ridge vent.
Figure 12:
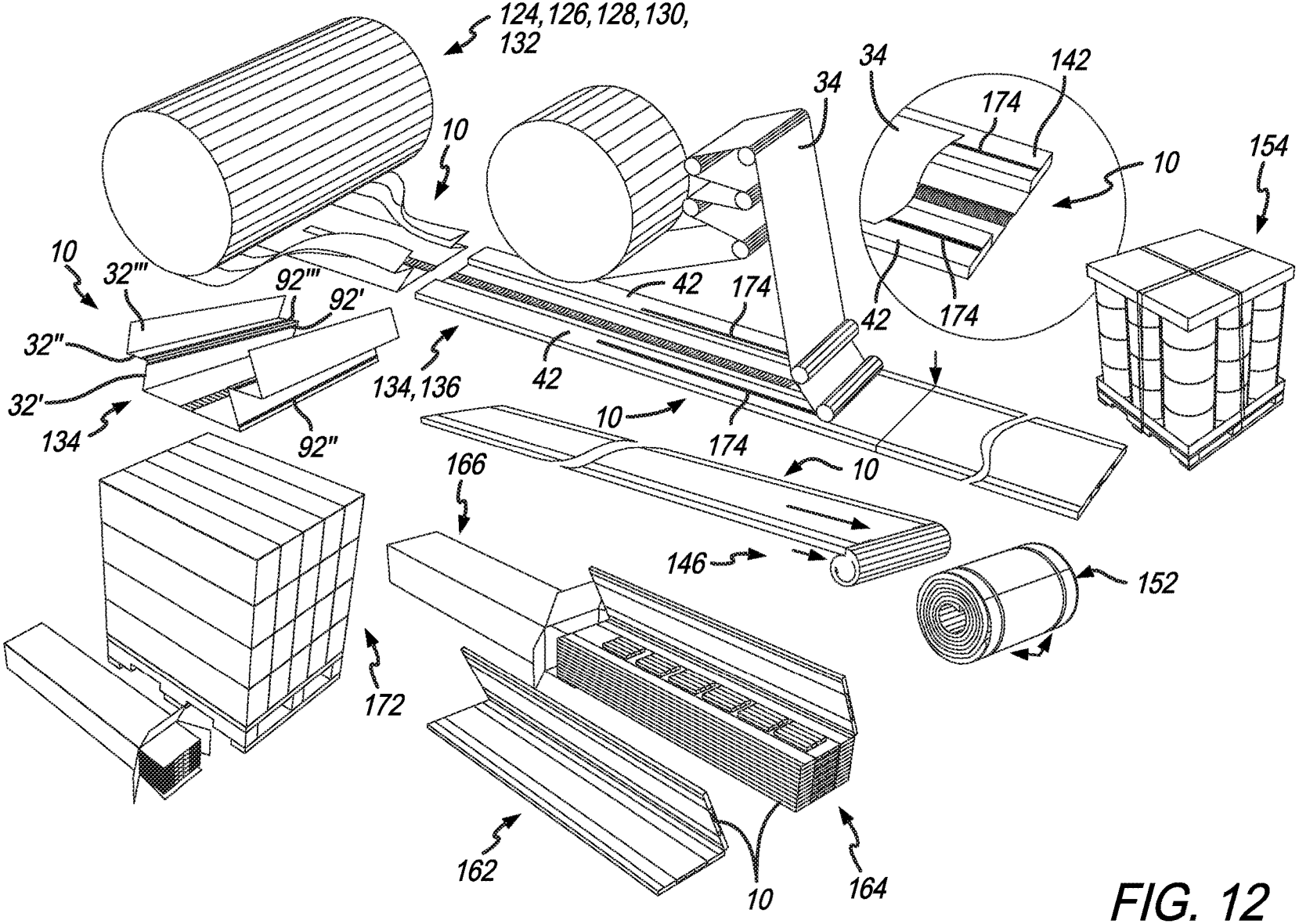
FIG. 12 is a perspective graphical representation of methods of making a ridge vent.

Vent panels 32, illustratively shown in FIGS. 1 and 2, are disposed under the outer edges 58 of top panel 30 in a stacked fashion as shown. They contain a multiplicity of airflow passages 46 oriented generally transverse to longitudinal axis 36 (see, also, FIG. 3). Vent panels 32 may be formed by scoring and folding a sheet of waterproof three-ply material 38 as depicted in FIGS. 7 and 12. Alternately, vent panels 32 may be cut separately and stacked beneath the outer edges 58 of top panel 30. Thus airflow passages 46 are formed extending from exterior edges 64 to interior edges 66 of each of vent panels 32. Airflow 25 may thus flow from underneath roof 12, through cutout slot 24, through airflow passages 46 of vent panels 32, and out exterior of roof 12.

Filtering fabric 34 may be secured (by means discussed further herein) along interior surface 52 of top panel 30, illustratively in the region of routed groove 54, and on bottom side 68 of the lowermost vent panel 32 extending the length of the ridge vent 10. Filtering fabric 34 may be of any thin, air permeable, water resistant, sheet material. Woven or nonwoven fabrics may be employed, as well as air permeable water resistant membranes that are not of fabric. Illustratively, it is believed that filtering fabric 34 may allow passage of about 75 percent of the air that would flow were it not present. Furthermore, filtering fabric 34 may be a nonwoven spunbonded material of randomly arranged synthetic polymer fibers.

As can be appreciated by FIGS. 1 and 2, when ridge vent 10 is installed, filtering fabric 34 forms a tent like structure. Any small amount of wind-blown precipitation, such as rain or snow that might be carried into the interior of ridge vent 10 through airflow passages 46, is stopped from traveling further by the water resistant filtering fabric 34, while air still passes through. If any rain or melted snow accumulates on top of filtering fabric 34, it drains from ridge vent 10, through the lowermost layer of airflow passages 46, in vent panels 32, onto roof 12, where it may run off shingles 22. Because of the tent like structure, and not being attached to the routed area of the vent in the center, heavy wind driven rain enters the vent on one side and travels over the fabric and then exits through the vent portion of the vent on the other side. A plug 47 may optionally be inserted in the end of ridge vent 10. The outer edges 58 of top panel 30 define outer openings 60 of airflow passages 46 (see, also, FIG. 1).

Figure 3:
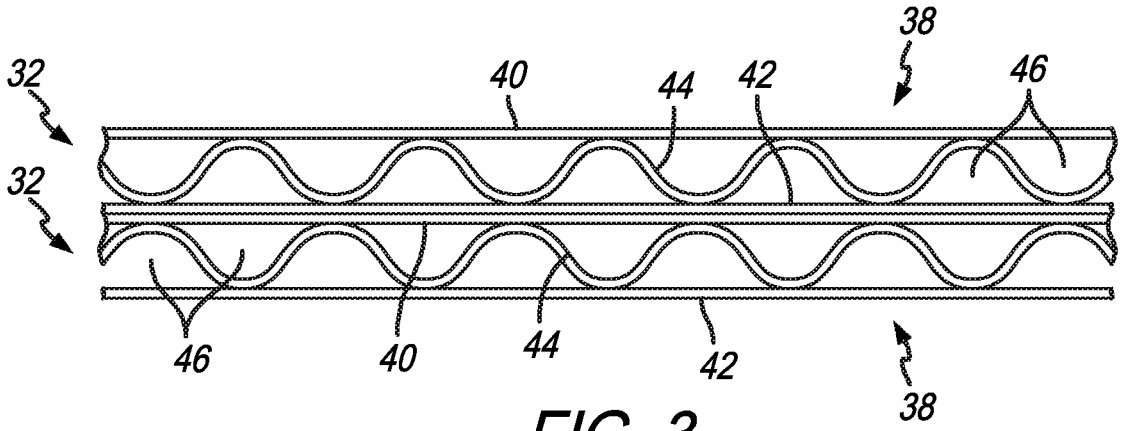
FIG. 3 is a side elevational view of a two layered vent panel.

A side elevational view of two layers of vent panels 32 are shown in FIG. 3. Vent panels 32 are made from weatherproof three ply material 38, including a top ply 40, a bottom ply 42, and an intermediate ply 44. Intermediate ply 44 defines the multiplicity of airflow passages 46 extending generally transversely to longitudinal axis 36 (see, also, FIG. 1). Illustratively, routed groove 54, shown in FIGS. 1 and 2, may extend through bottom ply 42 and into intermediate ply 44 defining inner openings 56 of airflow passages 46 (see, also, FIG. 1).

Figure 4:
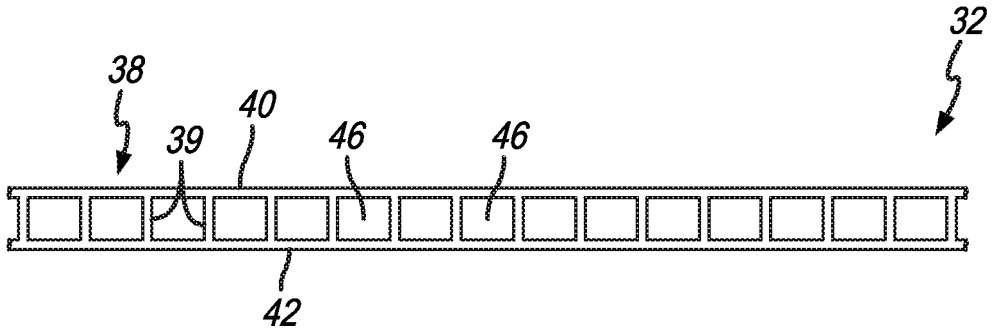
FIG. 4 is a side elevational view of an alternate configuration of a vent panel.
Figure 5:
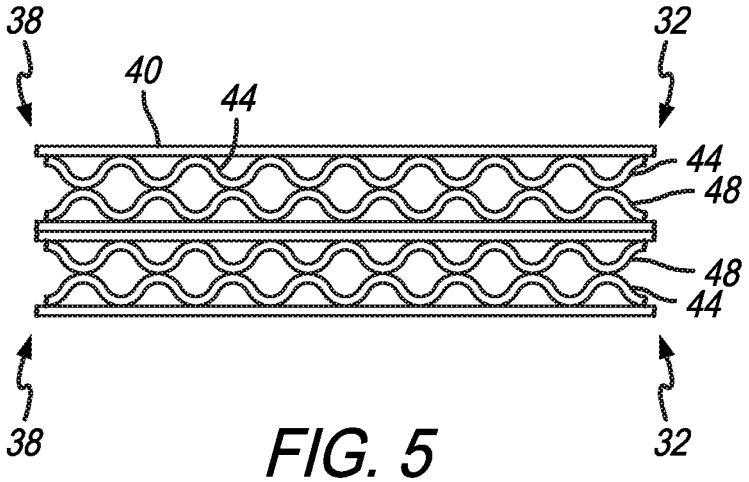
FIG. 5 is a side elevational view of another illustrative embodiment of a vent panel.

Side elevational views in FIGS. 4 and 5 depict illustrative alternate configurations of the three ply material 38 for vent panels 32. The embodiment in FIG. 4, for example, depicts a three ply material 38 where its intermediate ply is comprised of a series of cross walls 39 connecting top ply 40 to bottom ply 42 and defining a plurality of airflow passages 46 therebetween. The embodiment in FIG. 5 depicts a plurality of intermediate plies 44 and 48 in stacked arrangement to provide many generally parallel airflow passages 46 disposed therethrough. It will be appreciated by the skilled artisan upon reading this disclosure that any multitude of configurations may be employed to create the plurality of passageways from one side of the vent panel to the other. Such configurations are considered within the scope of this disclosure.

A characteristic of ridge vent 10 in the present disclosure that is in contrast to ridge vent 10 shown in FIG. 1, for example, of the '530 patent, is that there are no fasteners 62 attaching vent panels 32 to top panel 30. This is because in the present disclosure, vent panels 32 are attached to top panel 30 via an adhesive, particularly a polyurethane reactive (PUR) adhesive or glue. And, although, at the time of the '530 patent, it was thought adhesives could be used to attach the vent panels of the ridge vent to the top panel, it had subsequently been determined that this could not be done. Indeed, it became known to the skilled artisan that despite the attractiveness of adhesives being used to attach these components together, such attempts were failures. Instead, fasteners like staples 62 shown in the '530 patent were maintained as the attachment means for such ridge vents and are still used to this day.

A reason why an adhesive could not work on a ridge vent, such as the type disclosed in the '530 patent, was that it needed to be able to hold at temperatures that range from about −60° Fahrenheit up to about 180° Fahrenheit. Those skilled in the art of such ridge vents know that despite adhesives being able to secure adjacent vent panels together in a controlled environment, adhesives cannot be used to hold a ridge cap roof vent together in its use environment. Glues, such as polyamide-based hot melt, ethylene vinyl acetate (EVA)-based hot melt, and polyolefin-based hot melt adhesives, for example, are believed to delaminate at high temperatures. The glue essentially remelted becoming liquid again and lost its adhesive properties that held adjacent vent panels together. The result being the vent panels just stripping apart. Conversely, at frigid temperatures, the glues tended to crystallize and break apart. Accordingly, to the skilled artisan, adhesives do not work to attach vent panels together.

Still further, the skilled artisan found that glues also failed because they were not workable in a manufacturing environment for such ridge vents. For example, manufacture of these ridge vents take place at a rapid speed for efficient and profitable production. The time required for the glues to create a bond that would hold the adjacent panels together was not conducive to the manufacturing process. The material is partially folded and the glue is applied and then folded closed, and the time that it is closed together is very short. The manufacturing process pulls the material through at a rate of about 20 to 24 inches per second or 100 feet to 120 feet per minute. The green strength of such polyamide-based hot melt, ethylene vinyl acetate (EVA)-based hot melt, and polyolefin-based hot melt adhesives are believed not enough to hold adjacent vent panels together during manufacturing. These adhesives or glues were further unworkable in the sense that they needed to be heated to between about 375° to about 500° Fahrenheit to be properly viscous. This posed injury risks in the manufacturing environment that otherwise just involved cutting, scoring, folding, and rolling material. Introducing a high temperature adhesive, especially one that lacked green strength, created the potential for vent panels to delaminate and expose the hot glue to workers, thus, exacerbating manufacturing risks. Thus, it became clear that adhesives indeed did not work as an alternative to mechanical fasteners like staples to secure components of a ridge vent together.

Still further, the skilled artisan understood adhesives did not work for making ridge vents because such glues were typically shipped to a manufacturing plant in pellet form. These pellets required a progressive heating zone system of melting where the pellets travel from a storage location to an application location. The pellets are progressively heated to higher temperatures until fully melted at the application location. And because of the type of rolling, scoring, folding, and cutting involved in making the particular roof vents of the '530 patent, for example, there are numerous starts and stops of the line which is incompatible with the progressive heating zone requirement for adhesives. Stopping the line could cause the material to be overheated as it was left at a high temperature and would cause it to degrade from an over exposure to heat.

Furthermore, because of the type of manufacturing that includes rolling, scoring, folding, and cutting the vent panels and top panel to create the ridge vent, moisture is not an issue when mechanically attaching all of the components together. Moisture does not affect stapling the vent panels to the top panel. Accordingly, humidity was not a variable in the manufacturing process of making these vent panels. Moisture, however, is an issue with liquid adhesives. It was learned that when making such ridge vents using adhesives, moisture may inhibit bonding properties when applied to the vent panels. Such detrimental effects to the bonding characteristics served only to further exacerbate the failures in attempting to bond adjacent vent panels together. They required careful storage. Containers needed to be foil sealed to keep air and moisture out. Excess moisture caused the adhesive to foam as it evaporated during the melting process, which caused bubbles in the adhesive—which weakened the bond. Additionally, changes in relative humidity levels in the manufacturing environment that resulted from changes in external weather conditions throughout the year were believed to cause inconsistency in the performance of the adhesives and their ability to maintain a bond between the vent panels. In sum, the skilled artisan was aware that adhesives just did not work as a bonding alternative to mechanical fasteners for assembling a ridge vent of the type disclosed in the '530 patent.

Again, unexpectedly, however, a PUR adhesive was discovered to be able to bond vent panels together and to a top panel to make an assembled ridge vent employing no mechanical fasteners. It is believed that the PUR adhesive creates a chemical reaction that crosslinks the polymer chains sufficiently to create a permanent bond between adjacent surfaces that form the ridge vent. PUR adhesive appears to have thermoset-type properties so it does not remelt at high temperatures. This is advantageous when on a roof and having to withstand a 180° Fahrenheit environment. The PUR adhesive likewise withstands low temperatures and does not crystallize and/or break at subzero temperatures. Further, and also unexpectedly, in combination with those properties, the PUR adhesive was discovered to be sufficient for manufacturing by having enough green strength to create a sufficient initial bond between the vent panels and top panel to form the ridge vent and allowed for production of the ridge vent at the high speeds required in the production process. Still further, PUR adhesive does not appear to have an adverse reaction to varying moisture levels in the air. Indeed, it is believed that moisture might help cure the PUR adhesive better, particularly at the initial bonding stage where the aforementioned green strength is useful.

Moreover, the conventional gluing process may be dispensed with from the point of view that progressively heating glue pellets to their liquid form at high temperatures is not required. PUR glue may be applied sufficiently at the speed of manufacturing when heated to only about 250° F. to about 275° F. A PUR adhesive may be introduced into the manufacturing process as a solid, but progressive heating stages are not needed. Having an application temperature of only between about 250° F. to 275° F. creates a high enough viscosity to accommodate line manufacturing (see, FIGS. 10, 11, and 12). And, despite the sufficient green strength even in the presence of humidity, the PUR adhesive is flexible to allow the finished ridge vent to be rolled up for storage, shipping, and distribution.

Another unexpected advantage of the PUR glue is that it appears to be slightly expansive. The plastic material the top panel and vent panels are made from tend not to be exactly planar, especially with the intermediate ply 44 attached between top ply 40 and lower bottom ply 42 (see, FIG. 3). Rather, the outer surface of the panels may be slightly scalloped or wavy. With the PUR adhesive able to at least slightly expand, it fills voids between the panel surfaces to increase the bonding area. This all translates into an improved structural ridge vent where the individual components of the ridge vent are not separable under extreme temperatures while at the same time being manufacturable. This further translates into potentially fewer manufacturing defects which may reduce warranty events.

Figure 6:
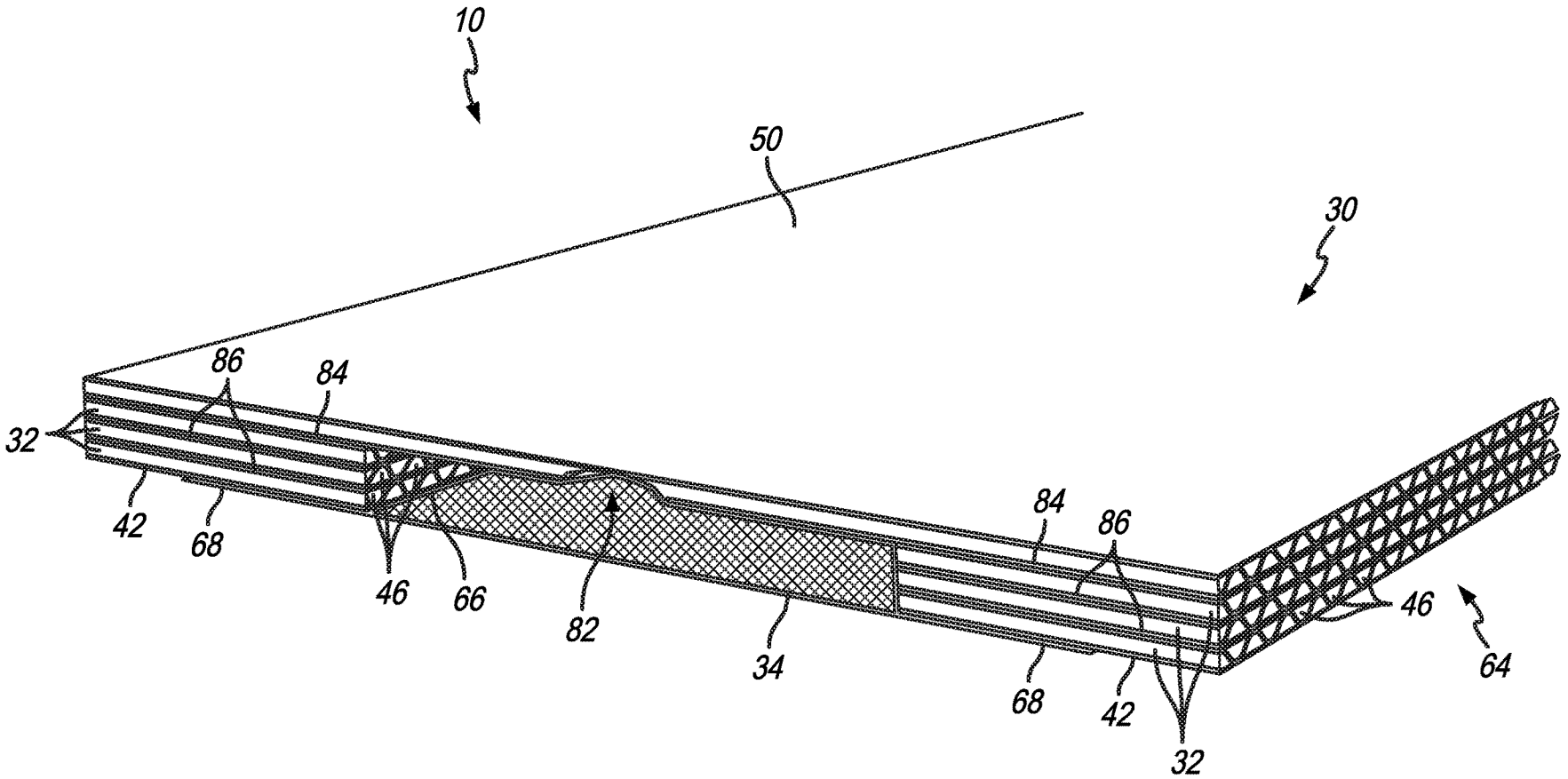
FIG. 6 is a perspective detail view of a portion of the ridge vent.

A perspective view of a portion of ridge vent 10 is shown in FIG. 6. This view shows top panel 30 affixed to vent panels 32 longitudinally extending on each side of top panel 30. This view also shows airflow passages 46 extending through vent panels 32 from interior edge 66 to exterior edge 64. Vent panels 32 longitudinally extend and attach to top panel 30 and are separated by opening 82 located therebetween. Opening 82 allows air moving up through cutout slot 24 and ridge 26 to allow airflow 25 to reach airflow passages 46 (see, also, FIGS. 1 and 2). Interfacings 84 are located between top panel 30 and vent panel 32. Interfacings 86 are located between successive vent panels 32. Optional embodiments may also include filtering fabric 34 attached to the lowermost vent panel 32 at bottom side 68, as illustratively shown.

It is notable, absent from ridge vent 10 is any mechanical fasteners disposed through exterior surface 50 of top panel 30 and down through the lowermost stacked vent panels 32, as employed in the '530 patent. Instead, a bead of PUR adhesive (see, also, FIG. 7) may extend the longitudinal extent of ridge vent 10 at interfacings 84, 86, and at bottom side 68. It is at these locations that top panel 30, or plurality of vent panels 32, and in certain embodiments filtering fabric 34, are all fixed together to form ridge vent 10 as shown. No longer are any fasteners, such as staples, needed to secure these components of ridge vent 10 together. That said, when using the PUR adhesive, the components of ridge vent 10 do not separate at the interfacings. Instead, a strong bond is unexpectedly created resistant to extreme temperatures and can allow the ridge vent to be manufacturable.

A perspective detail view of a portion of ridge vent 10, in a partial exploded view, is shown in FIG. 7. This is the same ridge vent 10 as shown in FIG. 6, except in pre-finished form. Here, top panel 30 is shown to have been scored at 90, 90', and 90" on each side, as shown. Such scoring creates a "Z" fold configuration of individual unassembled vent panel portions 32', 32", and 32'" on each side of top panel 30. Opposite scores 90, 90', and 90" are beads of PUR adhesive 92', 92", and 92'" on each side of ridge vent 10 as shown. Illustratively, bead lines 92', 92", 92'", extend along top ply 40 of each of the vent panels. It is appreciated that the liquid glue bead may be a single longitudinally extending bead as indicated in FIG. 7. Alternatively, the bead may be in a stitched arrangement where successive short lengths of glue are deposited on top ply 40. The bead of glue may still alternatively be deposited in a zig-zag configuration along top ply 40. The skilled artisan upon reading this disclosure will appreciate that the bead of glue may be deposited in any number of configurations—all of which are contemplated within the scope of this disclosure. Also, the skilled artisan will appreciate that in some embodiments, the bead of glue may be applied to bottom ply 42. In either case, once each portion of a vent panel 32', 32", and 32'" are joined together at respective top and bottom plies 40 and 42, respectively, the bead of glue will spread and adhere to both plies and begin forming a secured bond at each interfacing to form ridge vent 10 as shown in FIG. 6.

Also, shown in FIG. 7 is line 94 extending on filtering fabric 34 along the longitudinal extent of ridge vent 10. Line 94 represents the location on filtering fabric 34 that will contact a bead of glue that will be applied to bottom ply 42 on bottom side 68 of vent panel 32'". Line 94 is added for clarity to demonstrate the attachment location. In alternate embodiments, PUR adhesive may be applied to filtering fabric 34 and attached to planer bottom ply 42.

Figure 8:
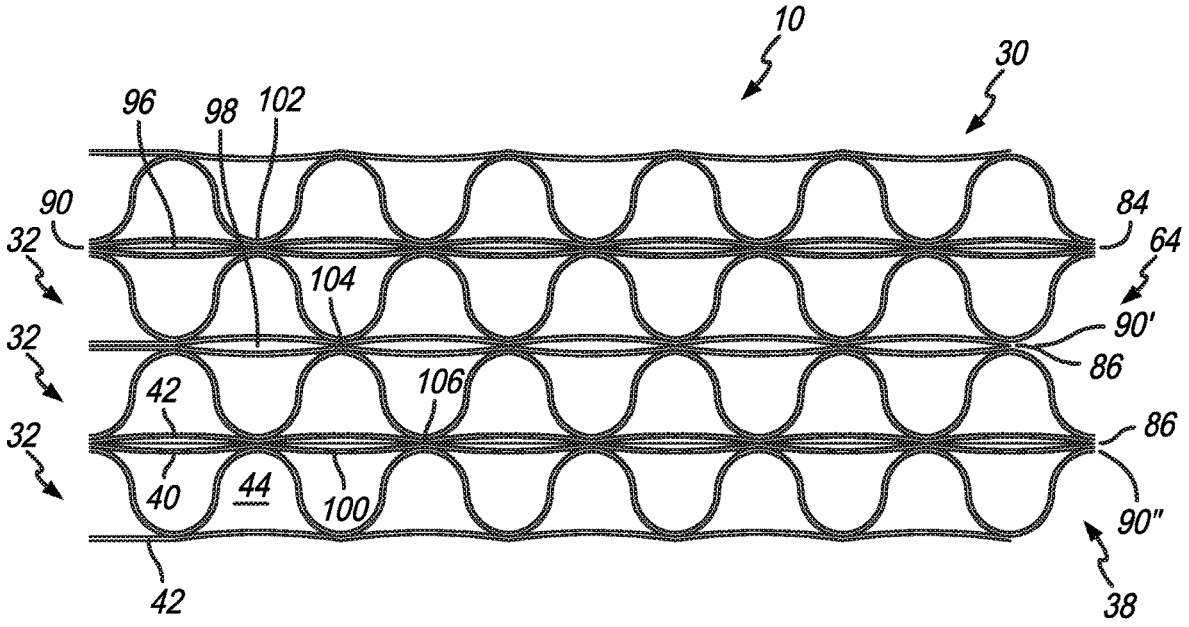
FIG. 8 is a side view of a portion of the ridge vent showing stacked vent panels.

A side view of a portion of ridge vent 10, showing exterior edges 64 of stacked vent panels 32 under top panel 30, is shown in FIG. 8. In this configuration, top panel 30 has been folded to form the stack of vent panels 32 as discussed with respect to FIGS. 6 and 7, showing scores 90, 90', and 90". In FIG. 8, no bead of PUR adhesive has been applied yet. Indeed, as shown herein, after folding portions of top panel 30, gaps 96, 98, and 100 may be formed at interfacings 84 and 86, respectively (see, also, FIG. 6). Because of the formation of top ply 40, bottom ply 42, and undulating intermediate ply 44, such gaps 96, 98, and 100 may be formed at the interfacings. When applying most glues, they would have a tendency of not filling in these gaps, but only adhere joining panels together at contact points such as contact points 102, 104, and 106 between the panel layers. And, even though along each of the interfacings there may be several contact points between the layers, it can be appreciated that along a line, a substantial portion of the interfacings will not contact each other because of gaps 96, 98, and 100 formed along each of the interfacings between 84 and 86.

Figure 9:
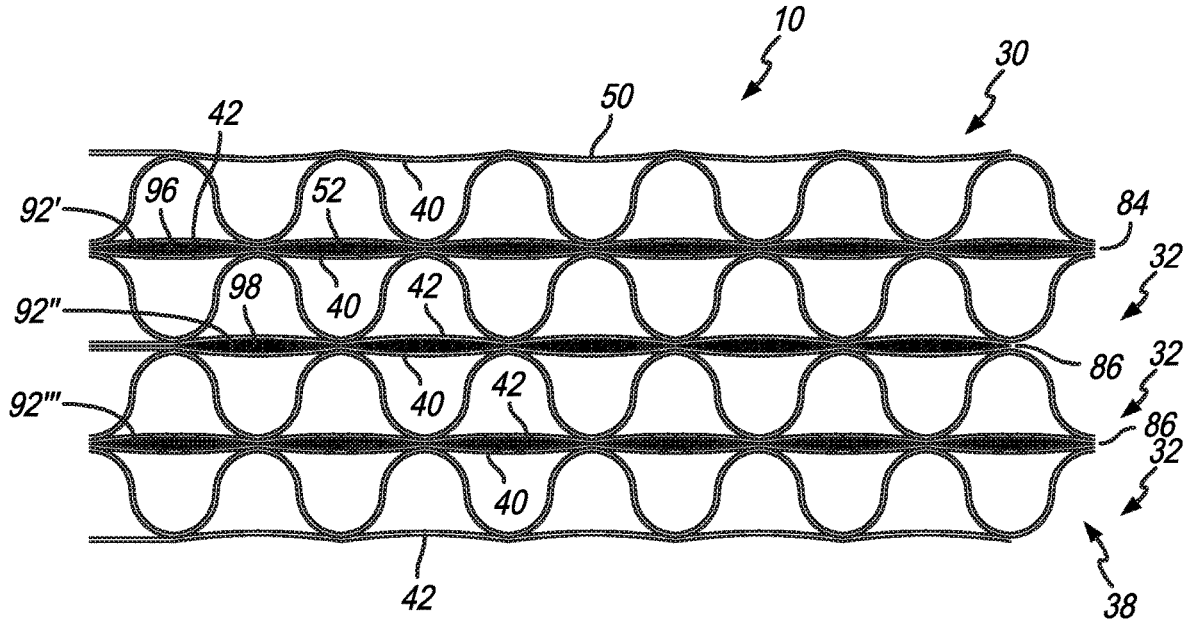
FIG. 9 is another side view of the ridge vent showing stacked vent panels.

Another side view of ridge vent 10, showing top panel 30 and stacked vent panels 32, is shown in FIG. 9. This view is similar to that shown in FIG. 8 except that here the bead of PUR adhesive, such as beads 92', 92", and 92'" fill in gaps 96, 98, and 100, respectively. Unexpectedly, filling in these gaps 96, 98, and 100, each extending along the longitudinal extent of ridge vent 10, means more of the surfaces of top ply 40 are secured to bottom ply 42 of adjacent vent panels 32. The same is the case between interior surface 52 and top ply 40 between top panel 30 and the topmost vent panel 32. This means for interfacings 84 and 86, between top panel 30 and vent panel 32, as well as the stack of vent panels 32, the beads of PUR adhesive 92', 92", 92'" both attaches the panels at contact points 102, 103, and 104, as well as at gaps 96, 98, and 100. This translates into significant surface area contact between adjacent plies at the interfacings to create a strong bond between panels.

Figure 10:
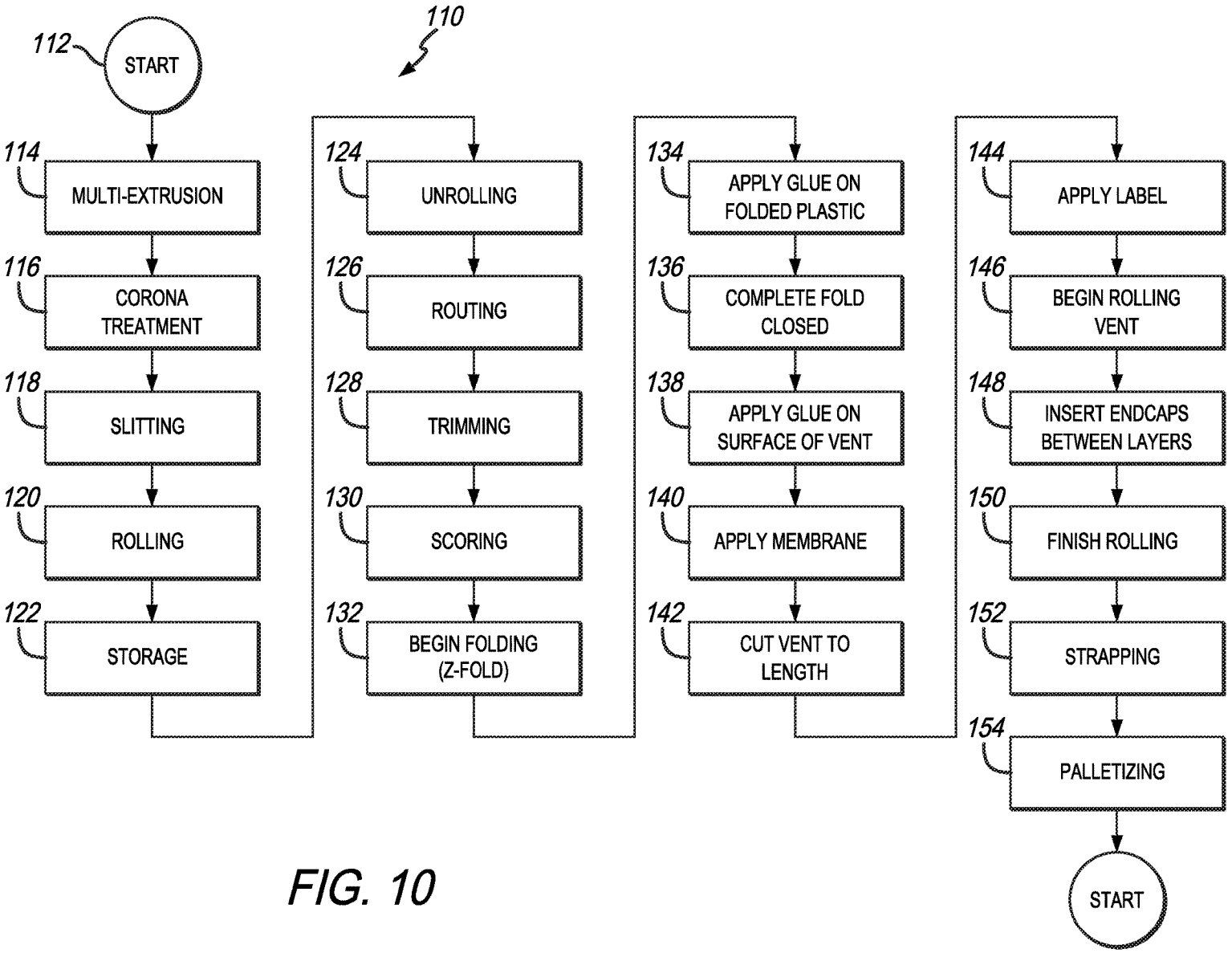
FIG. 10 is a flow diagram depicting an illustrative manufacturing method of a ridge vent.

Another aspect that makes PUR adhesive unexpectedly workable is that it can be integrated into a manufacturing process for the types of ridge vents shown herein. A flow diagram 110, depicting an illustrative manufacturing method for ridge vent 10, is shown in FIG. 10. From start 112, the material to make top panel 30, which will be scored and folded to create ridge vent 10, is first extruded at 114. Multiple extruders may illustratively create three webs of material to form the vent board—a top linear, a middle corrugated linear, and a bottom linear sheet—that are bonded together by heat and compression pressure to bond with each other. Next is a corona treatment 116. The HDPE plastic of the vent is chemically inert so materials do not want to stick to it. The corona treatment is a surface treatment for plastics so it will bond to other materials. It involves exposing the surface of the HDPE plastic to a high frequency corona discharge. The plastic surface, thus, becomes much more impressible to adhesives, inks, and coatings. It is believed the corona discharge by the material, results in breaking oxygen molecules into an atomic form. The atoms are then able to bond with the molecule ends present in the material surface that is being treated. Accordingly, the surface of that material becomes chemically active which means that the adhesive will now stick to the surface. The top panel 30 is made with enough width to form the stacks of vent panels 32 (see, also, FIG. 7) at slitting stage 118. The roll of corrugated plastic vent material is slit down to the correct size and the outside trim is removed since it is not used to make the vent material. At this point, the material for ridge vent 10 has been formed as the flat sheet. Now, it can be rolled at 120 for storage at 122. Here, the stored roll of material is awaiting the next step of the process which forms the formed ridge vent 10.

As further shown in FIG. 10, a roll of material may be removed from storage 122 and unrolled when needed at 124. The material may also be further trimmed at 128. At scoring 130, scores 90, 90', and 90" are formed in the sheet of material. The scores extend along the longitudinal extent of top panel 30 and will form the vent panel sections 32', 32", and 32'" (see, also, FIG. 7). Once the final scoring has been completed to create scores 90, 90', 90", top panel 30 and vent panel portions 32', 32", and 32'" are folded in the "Z" shape as shown in FIG. 7 to begin forming ridge vent 10 at 132.

The next stage shown in FIG. 10 creates a different ridge vent than that shown in the '530 patent. Again, rather than adding mechanical fasteners, such as staples, vent panel portions 32', 32", and 32'" receive a bead of PUR adhesive as shown by glue beads 92', 92", and 92'" in FIG. 7, at 134 shown in FIG. 10. When the PUR adhesive is applied, the vent panel portions are separated opposite score lines 90, 90', and 90", allowing space for the bead of glue. Again, it is appreciated that the application of the bead of glue may be of any variety of configurations and locations on the panels. Once the glue has been applied, vent panel portions 32', 32" and 32'" close at 136 to form the ridge vent design as shown with ridge vent 10 in FIG. 6. In further embodiments that include a filtering fabric, such as filtering fabric 34, or other like barrier or membrane, the PUR adhesive will be applied to bottom ply 42 of lowermost vent panel 32 at 138. Subsequently, the filtering fabric or membrane, such as filtering fabric 34, is applied onto planer bottom ply 42 at 140, and as shown in FIG. 6.

At this stage, ridge vent 10 is fully formed. It is appreciated that ridge vent 10 can be assembled by this method, particularly from scoring at 130 through "Z" folding at 132, applying the PUR adhesive at 134, and folding enclosed ridge vent 10 at 136, which may take about 2 to 4 seconds. Applying the adhesive for filtering fabric 34, and applying same at steps 138 and 140 may only take about 1 to 2 additional seconds. It is even further appreciated that ridge vent 10 may be sold to end-users as rolls (see, FIG. 1), or as for 4 foot sticks (although these lengths are illustrative). Both are standard means of purchasing ridge vents. At step 142 in FIG. 10, the finished ridge vent 10 is then cut to the appropriate length. In this demonstrative embodiment, it is contemplated that ridge vent 10 will be distributed as a 20 foot roll though any length of roll can be produced. The distinction is noted, not only for purposes of how the remainder of the manufacturing process will proceed (as in contrast to FIG. 11), but also to note that another unexpected aspect of the PUR adhesive is that even though it has been applied at several interfacings at different thicknesses of ridge vent 10, and along the longitudinal extent thereof, ridge vent 10 is able to be rolled up without the PUR adhesive becoming too rigid or stiff to prevent the rolling, but also to be able to cure to its final state while being rolled. After step 134, when adhesive is initially applied to the ridge vent, and at step 136, when the vent panels are folded and closed, the superior green strength of the PUR adhesive immediately creates a bond that secures the vent panels for the duration of the manufacturing process through step 140 where the fabric is applied to the vent. The adhesive bond continues to improve in strength after application, and the bond becomes fully cured within 48 hours. This allows ridge vent 10 to be finalized and rolled without being too rigid or not being able to finally cure. The roll is kept rolled by placing bands around the product. The pressure applied to the interfacings, while ridge vent 10 is rolled up, is sufficient pressure to allow the PUR adhesive to fully cure and create an effective permanent bond at the interfacings. Conversely, ridge vent 10 will be able to be unrolled and attached to a rooftop as shown in FIG. 1 without the PUR adhesive at the interfacings creating a rigid structure that would make unrolling difficult.

As part of the final process of this embodiment of ridge vent 10, it is cut to its 20 foot length at step 142 and necessary labeling applied at 144. Ridge vent 10 is rolled at step 146. End caps between layers are inserted at 148 which serve as a weather barrier that closes off the openings on the end of the vent and prevents outside elements from entering the dwelling through the vent. The end caps are provided with the finished ridge vent, but are detached from the vent and need to be applied by the end user when the ridge vent is installed on a roof. The end caps are inserted into the roll as it is being rolled up, they are located in the last 4 feet of the roll. At step 150, ridge vent 10 is finished being rolled up.

To maintain the roll and allow it to further cure, strapping is wrapped around the roll of ridge vent 10 at 152. It is contemplated that the strapping will be removed by the end user which will allow ridge vent 10 in this rolled configuration to be unrolled and installed on a rooftop. Finally, multiple roles of ridge vent 10 may be palletized at step 154 for distribution. All during this time, the further unexpected benefit is realized by the PUR adhesive engaging in its final cure while at the same time the ridge vent is able to be rolled, strapped, and palletized for distribution. Combining these final steps provides efficiencies in the manufacturing process. The final cure time of the PUR adhesive may be as much as 24 hours, but that can occur while the roles of ridge vent 10 are in storage waiting for distribution.

Figure 11:
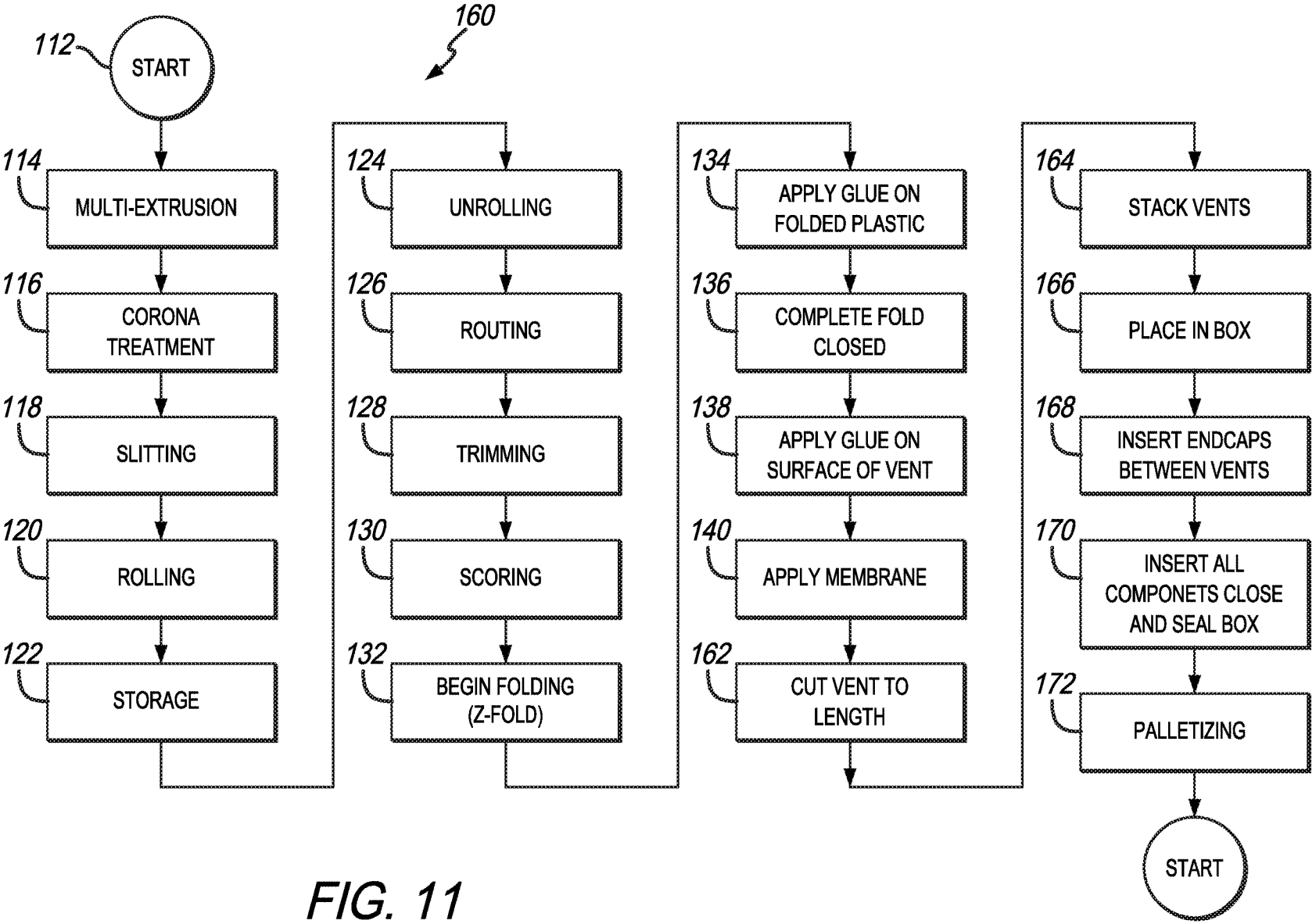
FIG. 11 is a flow diagram depicting another illustrative embodiment of a method of making a ridge vent.

Another illustrative embodiment of a method of making ridge vent 10 includes cutting it into 4 foot sticks rather than the 20 foot roll. The ridge vent structure itself is identical to the roll of the structure, except it is cut into 4 foot lengths, stacked, and placed in a box for shipping. Method 160, shown in the flow diagram of FIG. 11, is identical to the method shown in FIG. 10, except step 142 of FIG. 10, where ridge vent 10 is cut to length as a 20 foot section, step 162 shown in FIG. 11 cuts ridge vent 10 to successive 4 foot section lengths. As further distinguishing in method 160 shown in FIG. 11, after ridge vent 10 is cut into 4 foot lengths, illustratively, one at a time in rapid succession, they are stacked at step 164. Once stacked, they are boxed at step 166. End caps are inserted between vents by hand. Illustratively, enough end caps may be provided to go into the ends of each 4 foot section. The end caps serve as a weather barrier that close off the openings on the end of the vent and prevent outside elements from entering the home through the vent. The end caps are provided with the finished ridge vent at 168, but are detached from the vent and are to be applied by the end user when the ridge vent is installed on a roof. Finally, the box is closed and sealed at 170. It is notable, that the pressure from being rolled over the 20 foot section of ridge vent 10 provides enough pressure (particularly when strapped) to properly cure the PUR adhesive to create the permanent bond by stacking and boxing 4 foot sections of ridge vent 10. There is sufficient pressure generated by this packaging step to sufficiently cure the PUR adhesive as well. So, even though in the embodiment shown in FIG. 11, ridge vent 10 is not rolled, the boxed and sealed 4 foot lengths, nonetheless, cure while palletized at 172 and placed in storage being ready for distribution.

Perspective graphical representations of methods of making ridge vent 10 according to methods 110 and 160 in both rolled and 4 foot stick form, are shown in FIG. 12. For both methods, the role of material that makes ridge vent 10, after being formed, is unrolled according to step 124, routed according to step 126, trimmed according to step 128, scored according to step 130, and folded according to step 132. The PUR adhesive is then applied according to step 134 and vent panels 32 folded closed onto top panel 130 at step 136. The PUR adhesive is then applied onto bottom ply 42 of ridge vent 10 at 174 according to step 138, and membrane or filtering fabric 34 applied thereon according to step 140. Once filtering fabric 34 is applied, ridge vent 10 is then cut to length. According to method 110, ridge vent 10 is cut to a longer length at 142 and then rolled up and banded according to steps 146 and 152. The roles of ridge vent 10 are then palletized according to step 154. In contrast, according to method 160, ridge vent 10 is cut to length at 162, stacked at step 164, boxed at step 166, and palletized at 172. It may be appreciated from this view that whether ridge vent 10 is being rolled according to step 152 or stacked according to step 164, pressure will be applied to the layers of vent panels 32 on top panel 30 in order to create pressure needed for the final cure of the PUR adhesive.

Figure 13:
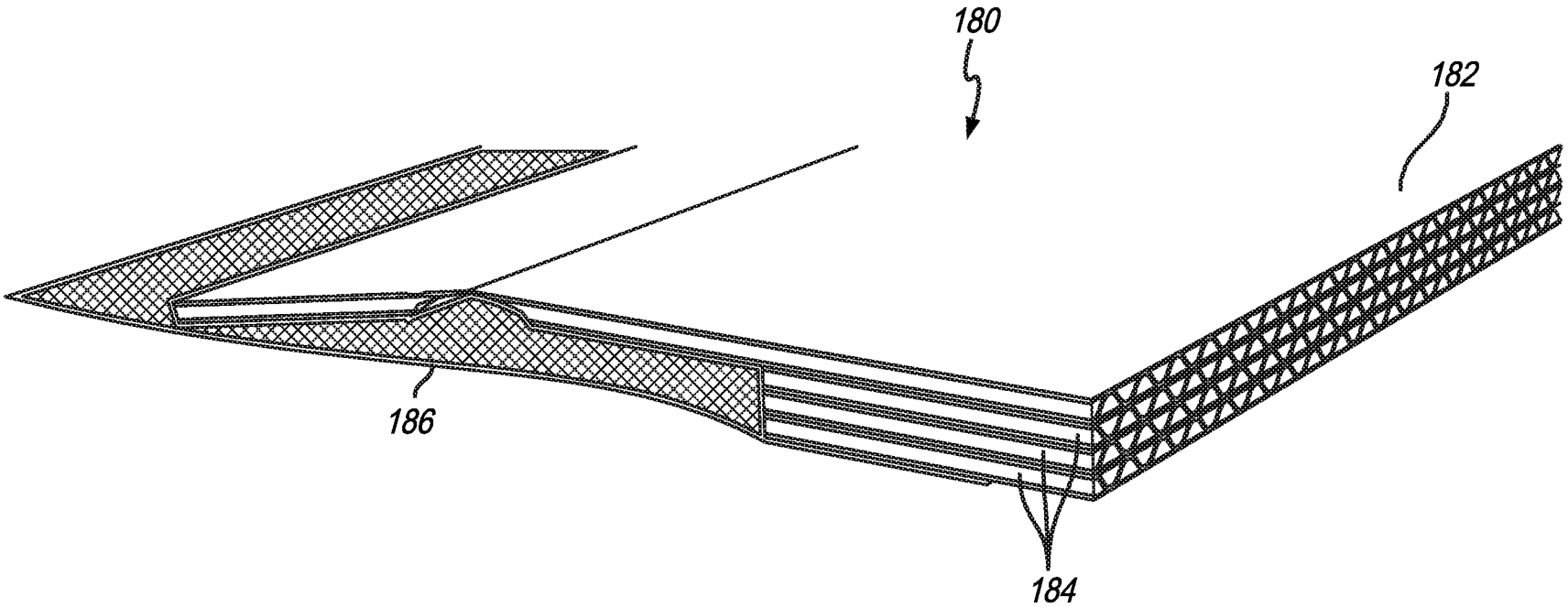
FIG. 13 is a perspective detail view of a portion of a shed-style roof vent.

An alternate embodiment of a ridge vent includes a shed roof vent adapted for shed style roofs. A perspective detail view of a portion of a shed roof vent 180 is shown in FIG. 13. Shown in this view are vent panels 184 stacked and attached to top panel 182. Filtering fabric 186 is shown attached to the underside of the stacks of vent panels 184 in the underside of top panel 182. The venting function of this embodiment is similar to that described with respect to ridge vent 10, and as further described in the specification, and FIG. 8 of the '530 patent. The distinction here, however, from the embodiment shown in the '530 patent, is that vent panels 184 and top panel 182 are all attached to each other via PUR adhesive in a manner as previously described with respect to ridge vent 10.

Figure 14:
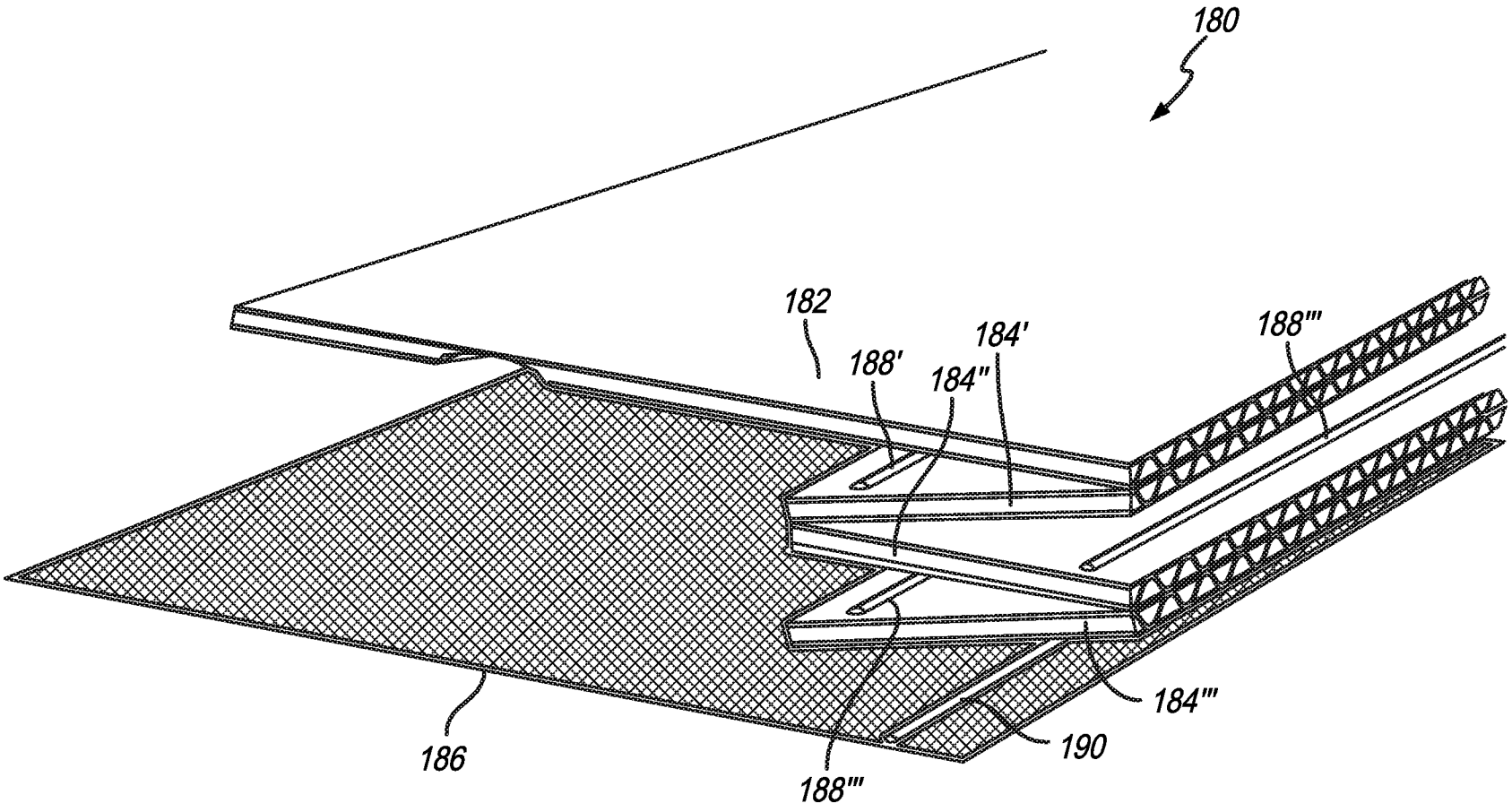
FIG. 14 is an unassembled partially exploded perspective detail view of the shed-style roof vent.

A perspective detail partially exploded view of shed roof vent 180 is shown in FIG. 14. Here, vent panel portions 184', 184", and 184'" are attached to each other and top panel 182 via beads of PUR adhesive 188', 188", and 188'". Again, this attachment is substantively the same as that previously shown to make ridge vent 10. Line 190 on filtering fabric 186 indicates the location that a bead of PUR adhesive will contact filtering fabric 186 to adhere to the underside of the lowermost vent panel 184. It is appreciated that these disclosed embodiments, as well as others, may be assembled using PUR adhesive rather than one or more mechanical fasteners.

Figure 15A:
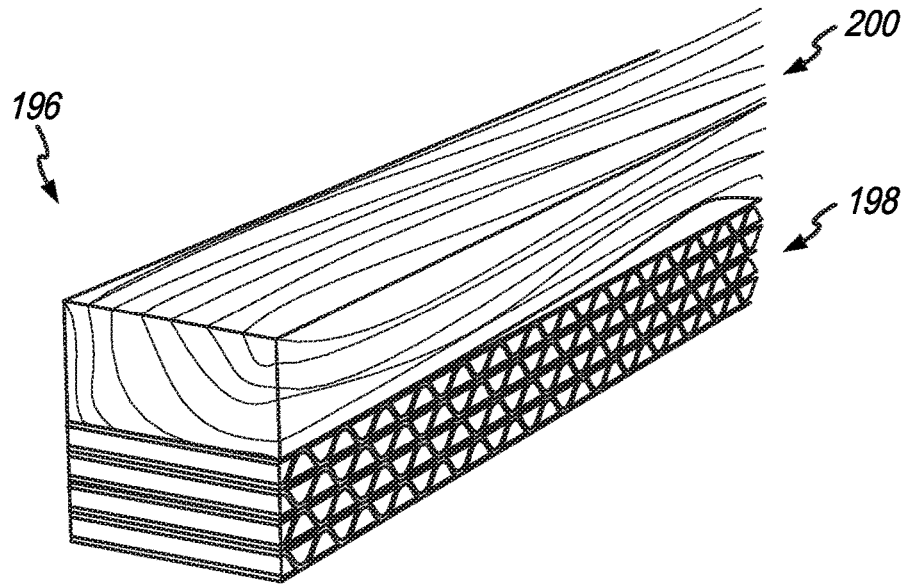
FIG. 15A is a perspective detail view of a portion of a structural batten.
Figure 15B:
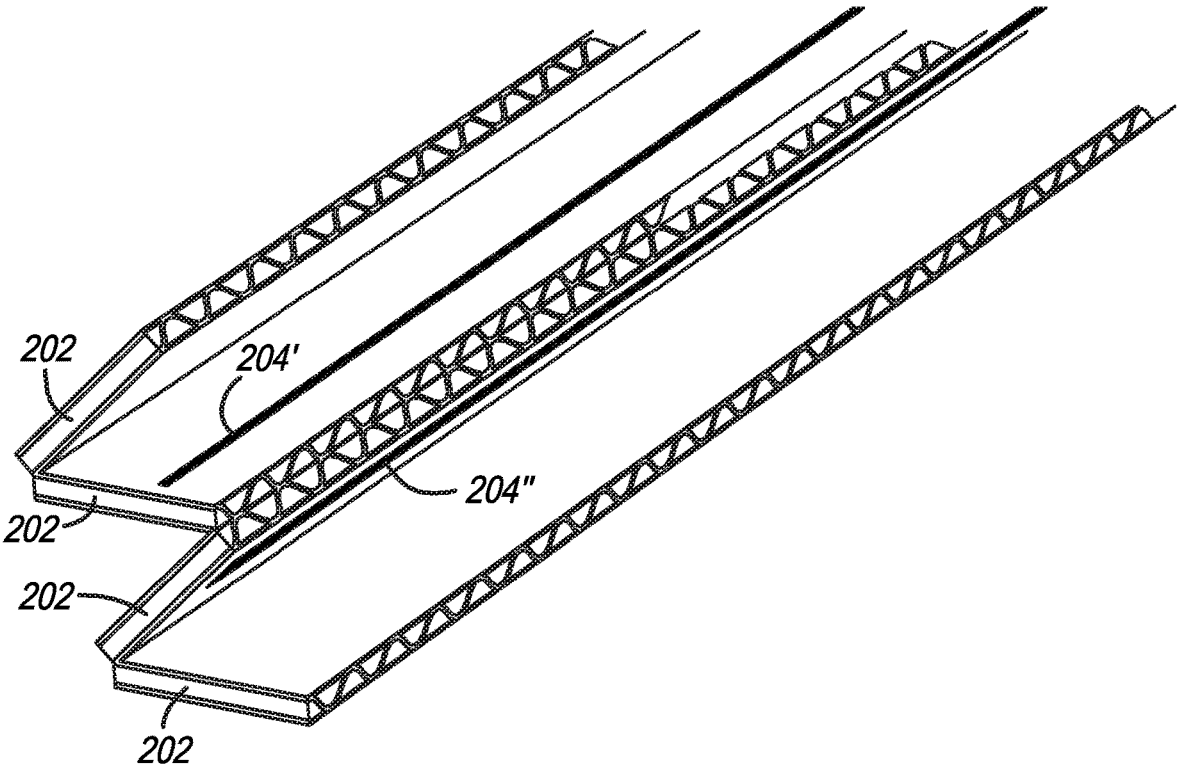
FIG. 15B is an unassembled partially exploded perspective detail view of a portion of the structural batten.
Figure 15C:
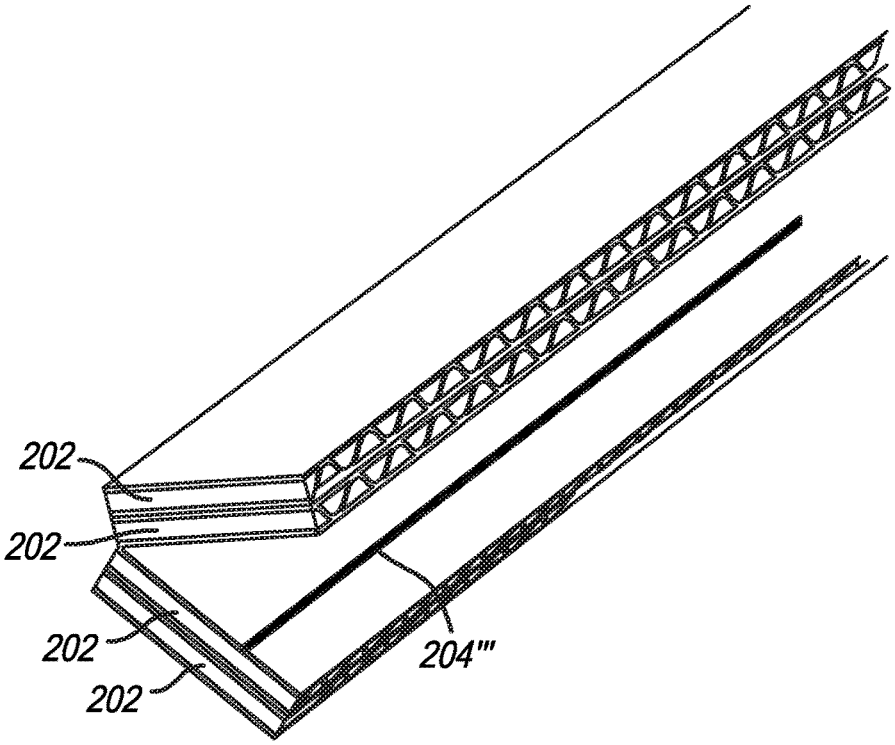
FIG. 15C is another partially exploded perspective detail view of a portion of the structural batten.

Another illustrative embodiment of the present disclosure includes furring strips and battens that employ the same venting materials as that shown with respect to ridge vent 10 and shown in FIGS. 3 through 4. Perspective detail views of structural batten 196 are shown in FIGS. 15A, 15B, 15C, and 15D. Structural batten 196 shown in FIG. 15A illustratively includes a vented component 198, and a solid component 200 attached to vented component 198. Such structural batten 196 is of the type disclosed in U.S. Pat. No. 9,676,165 titled "Structural Batten," issued Jun. 13, 2017, the disclosure of which is incorporated herein by reference. The embodiment of such structural batten 196, as shown in the present disclosure, is different in that it is held together using a PUR adhesive. As shown in FIGS. 15B and 15C, vented component 198 is composed of separate vent panels 202, similar to vent panels 32 of ridge vent 10. Indeed, vent panels 202 may be scored and folded in the same manner as vent panels 32. A bead of PUR adhesive 204' and 204" can be applied to vent panels 202 as shown in FIG. 15B to secure vent panels 202 together to form vented component 198. The skilled artisan will appreciate from reading the disclosure herein that a PUR adhesive bead or layer may be a single line, such as that shown herein, a stitched line, a zig-zag, or have other configuration best suited to ensure adjoining materials are attached together.

Figure 15D:
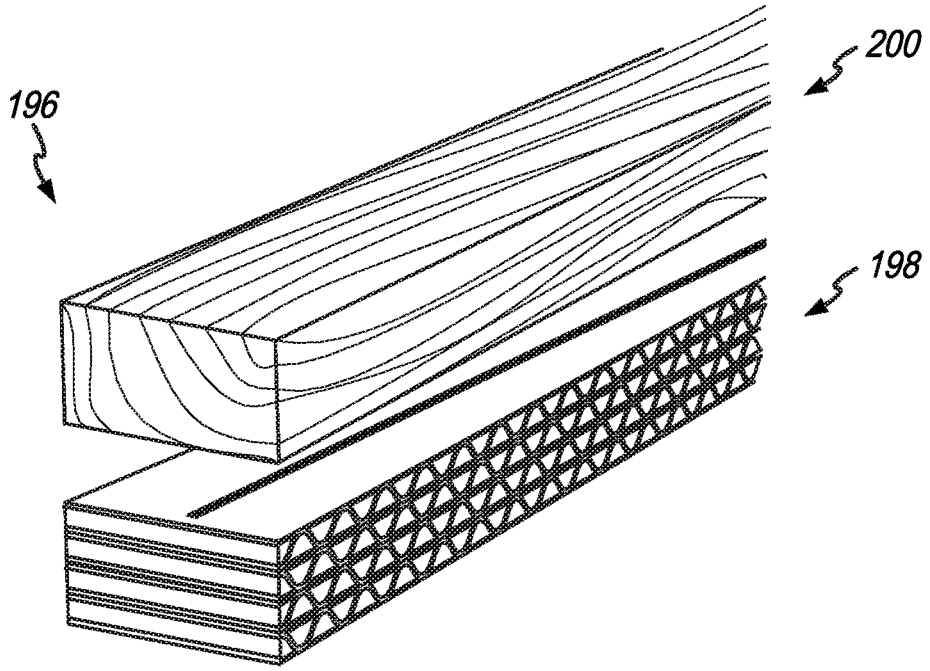
FIG. 15D is another perspective partially exploded detail view of the structural batten.

The view in FIG. 15C is a reversal of that shown in FIG. 15B in that bead 204''' is shown applied to one of vent panels 202 to secure and join the vent panel thereto. The view in FIG. 15D depicts vented component 198 with a bead of PUR adhesive 206 applied thereon to secure solid component 200 onto vented component 198. It will be further appreciated by the skilled artisan that other like vented furring strips and battens of the type disclosed in U.S. Pat. No. 6,938,383, entitled "Vented Furring Strip," issued Sep. 6, 2005, and U.S. Pat. No. 7,117,649 entitled "Vented Furring Strip" issued Oct. 10, 2006, may be assembled in the same manner as disclosed herein employing the PUR adhesive instead of other attachment means. These patents are herein incorporated in their entirety by reference.

In the drawings, some structural or method features may be shown in specific arrangements and/or orderings. However, it should be appreciated that such specific arrangements and/or orderings may not be required. Rather, in some embodiments, such features may be arranged in a different manner and/or order than shown in the illustrative figures. Additionally, the inclusion of a structural or method feature in a particular figure is not meant to imply that such feature is required in all embodiments and, in some embodiments, may not be included or may be combined with other features. It should also be appreciated that, to the extent any subject matter disclosed in this Non-Provisional Patent Application differs from the priority Application, the disclosure from this non-provisional Patent Application controls.

What is claimed:

1. A venting device of a structure, comprising:

a first panel section;

wherein the first panel section includes a first panel surface; and a second panel section;

wherein the second panel section includes a second panel surface;

wherein the first panel surface of the first panel section faces the second panel surface of the second panel section; and wherein a polyurethane reactive (PUR) adhesive is located between the first panel surface of the first panel section and the second panel surface of the second panel section which holds the first panel surface of the first panel section and the second panel surface of the second panel section together.

2. The venting device of claim 1, further comprising an third panel section that includes a fourth panel surface and the second panel section includes a third panel surface wherein a PUR adhesive is located between the third panel surface of the second panel section and the fourth panel surface of the third panel section which holds the third panel surface of the second panel section and the fourth panel surface of the third panel section together.

3. The venting device of claim 1, wherein at least one gap is located between a portion of the first panel surface of the first panel section and a portion of the second panel surface of the second panel section, wherein at least a portion of the PUR adhesive fills at least a portion of the at least one gap.

4. The venting device of claim 1, wherein the first panel section and the second panel section are not held together by a mechanical fastener.

5. The venting device of claim 1, wherein the venting device is sized to cover an opening located on a roof.

6. The venting device of claim 1, wherein the first panel section and the second panel section are composed of a high-density polyethylene.

7. The venting device of claim 1, wherein the PUR adhesive located between the first panel surface of the first panel section and the second panel surface of the second panel section are held together in an outdoor environment.

8. The venting device of claim 1, wherein at least one line of PUR adhesive extends at least a portion of a length of the first panel section and the second panel section.

9. The venting device of claim 1, further comprising a plurality of lines of PUR adhesive that extend at least a portion of a length of the first panel section and the second panel section.

10. The venting device of claim 1, wherein the first panel section is an elongate first panel section that includes a multiplicity of discrete air passages and the second panel section is an elongate second panel section that includes a multiplicity of discrete air passages.

11. The venting device of claim 2, wherein the third panel section is an elongate third panel section that includes a multiplicity of discrete air passages.

12. The venting device of claim 2, wherein the first panel section is an elongate first panel section that includes a multiplicity of discrete air passages, the second panel section is an elongate second panel section that includes a multiplicity of discrete air passages, and the third panel section is an elongate third panel section that includes a multiplicity of discrete air passages.

13. A venting device of a structure, comprising:

a first panel section that includes at least one passage;

wherein the at least one passage of the first panel section is bounded by a top panel portion and a base panel portion located opposite the top panel portion; and a second panel section that includes at least one air passage;

wherein the at least one air passage of the second panel section is bounded by a top panel portion and a base panel portion located opposite the top panel portion;

wherein a bottom surface of the base panel portion of the first panel section faces a top surface of the top panel portion of the second panel section; and wherein a polyurethane reactive (PUR) adhesive is located between the bottom surface of the base panel portion of the first panel section and the top surface of the top panel portion of the second panel section which holds the bottom surface of the base panel portion of the first panel section and the top surface of the top panel portion of the second panel section together.

14. The venting device of claim 13, further comprising a third panel section that includes a top panel portion and a base panel portion located opposite the top panel portion, wherein a bottom surface of the base panel portion of the second panel section faces a top surface of the top panel portion of the third panel section, and wherein a PUR adhesive is located between the bottom surface of the base panel portion of the second panel section and the top surface of the top panel portion of the third panel section which holds the bottom surface of the base panel portion of the second panel section and the top surface of the top panel portion of the third panel section together.

15. The venting device of claim 13, wherein at least one gap is located between a portion of the bottom surface of the base panel portion of the first panel section and a portion of the top surface of the top panel portion of the second panel section, wherein at least a portion of the PUR adhesive fills at least a portion of the at least one gap.

16. The venting device of claim 13, wherein the first panel section and the second panel section are composed of a high-density polyethylene.

17. The venting device of claim 13, wherein the PUR adhesive located between the bottom surface of the base panel portion of the first panel section and the top surface of the top panel portion of the second panel section holds the bottom surface of the base panel portion of the first panel section and the top surface of the top panel portion of the second panel section together in an outdoor environment.

18. The venting device of claim 13, wherein at least one line of PUR adhesive extends at least a portion of a length of the first panel section and the second panel section.

* * * * *